US006796209B2

(12) United States Patent
Boss

(10) Patent No.: US 6,796,209 B2
(45) Date of Patent: Sep. 28, 2004

(54) CUTTING MACHINE FOR AUTOMATIC TRIMMING OF PRINTED PRODUCTS

(75) Inventor: Heinz Boss, Strengelbach (CH)

(73) Assignee: Grapha-Holding AG, Hergiswil (CH)

( * ) Notice: Subject to any disclaimer, the term of this patent is extended or adjusted under 35 U.S.C. 154(b) by 180 days.

(21) Appl. No.: 09/870,551

(22) Filed: May 30, 2001

(65) Prior Publication Data

US 2002/0144581 A1 Oct. 10, 2002

(30) Foreign Application Priority Data

Jun. 26, 2000 (EP) ..... 00810557

(51) Int. Cl.[7] ..... B26D 1/56; B26D 5/34

(52) U.S. Cl. ..... 83/365; 83/404; 83/408

(58) Field of Search ..... 83/365, 404, 455, 83/461, 934, 581.1, 404.4, 415, 454, 155, 88, 152, 432.2, 404.3, 408, 435.2, 500, 37, 300, 303, 404.2, 404.1, 328

(56) References Cited

U.S. PATENT DOCUMENTS

| | | | | | |
|---|---|---|---|---|---|
| 2,978,943 | A | | 4/1961 | Balint | |
| 3,528,332 | A | * | 9/1970 | Thumim | 83/214 |
| 3,884,102 | A | * | 5/1975 | Faltin | 83/155 |
| 4,300,427 | A | * | 11/1981 | Rathert | 83/519 |
| 4,463,677 | A | * | 8/1984 | Kuehfuss | 101/483 |
| 4,519,868 | A | * | 5/1985 | Hoffmann | 156/353 |
| 4,615,249 | A | * | 10/1986 | Geiser | 83/221 |
| 4,781,090 | A | * | 11/1988 | Feldkamper et al. | 83/74 |
| 5,125,304 | A | * | 6/1992 | Petersen | 83/100 |
| 5,586,479 | A | * | 12/1996 | Roy et al. | 83/74 |
| 6,152,002 | A | * | 11/2000 | Muller | 83/37 |
| 6,260,457 | B1 | * | 7/2001 | Hakkaku | 83/167 |

FOREIGN PATENT DOCUMENTS

| | | |
|---|---|---|
| DE | 1461215 | 3/1969 |
| DE | 2120240 | 11/1972 |
| DE | 4011821 | 10/1991 |
| DE | 197 20 042 A1 | 9/1998 |
| EP | 0001565 | 5/1979 |
| EP | 0091714 | 10/1983 |
| EP | 0698451 | 2/1996 |
| EP | 0941817 | 9/1999 |

OTHER PUBLICATIONS

Patent Abstracts of Japan, vol. 018, No. 543 (M–1687), Oct. 17, 1994 & JP 06 191180 A (Osako Seisakusho:KK), Jul. 12, 1994.

* cited by examiner

*Primary Examiner*—Allan N. Shoap
*Assistant Examiner*—Ghassem Alie

(57) ABSTRACT

A cutting machine for automatically trimming edges of folded printed products has a first cutting station with a cutting element for performing a front cut at a front cut location on an open side of the printed products. A feeding device transports the printed products to the first cutting station. A transport device transports the printed products received from the feeding device in a transport direction through the first cutting station. A measuring device measures a position of each of the printed products in the first cutting station before reaching a cutting position. A control device controls the transport device based on the position measured by the measuring device such that a deviation of the position measured by the measuring device from a nominal position is corrected during further transport of the printed products.

14 Claims, 4 Drawing Sheets

CUTTING MACHINE FOR AUTOMATIC TRIMMING OF PRINTED PRODUCTS

BACKGROUND OF THE INVENTION

1. Field of the Invention

The invention relates to a cutting machine for automatic trimming of edges of folded printed products such as brochures, magazines, catalogs, comprising at least one cutting station comprising a knife for the front cut at the open side of the printed products, further comprising a feeding device for the transport of the printed products to the cutting station, and further comprising a transport device for transporting the printed products within the cutting station.

2. Description of the Related Art

Cutting machines of this kind are known in the prior art, for example, from European patent application 0 941 817 of the assignee of the instant application for patent. With such a cutting machine, printed products can be automatically cut or trimmed at the front, at the foot and the head and can thus be trimmed on three sides. In the first cutting station, the front cut and in the second cutting station at the same time the head cut and the foot cut are performed. The printed products are guided within the transport device against mechanical stops with the fold area leading and are aligned at the stops. The fold thus provides a reference edge, and the front cut is performed at a certain spacing to this reference edge. The transport of the printed products into the first cutting station and between the first and the second cutting stations is carried out with upper and lower belts. These belts are intermittently driven by a mechanical step-by-step gear mechanism or by a slider crank.

In order to enable alignment of the printed products at the mechanical stops, they must be released in front of the stops by lifting the upper belts, respectively.

With the known cutting machine, printed products with very different formats and different thickness can be cut. For most printed products, a very precise front cut can be performed with high output, i.e., the spacing between the folded area and the front cut is within the desired tolerances. For thick and bulky printed products these tolerances in the direction of width are relatively great and can be within the range of approximately 1 mm. It was found that such thick and bulky printed products, when reaching the first cutting station, can fan out and this reduces the cutting precision of the front cut. Moreover, it was found that other external effects as well as the occurring acceleration and deceleration values as well as the mechanical play within the gear mechanism can also reduce the cutting precision.

SUMMARY OF THE INVENTION

It is an object of the present invention to provide a cutting machine of the aforementioned kind with which smaller cutting tolerances can be ensured even for thick and bulky printed products.

In accordance with the present invention, this is achieved in that measuring means are provided with which, in the cutting station and before reaching the cutting position, the position of each printed product is measured and in that the transport device is controlled based on the result of the measurement such that a deviation from the nominal position is corrected during further transport.

With the cutting machine according to the invention, positional errors of the printed products, which result from fanning out of the printed products during transport as well as from other effects, are corrected based on the position measurement and the corresponding control of the transport device. By means of the control it is possible to correct positional deviations for each individual printed product and to minimize accordingly the cutting tolerances for the product width. When it is determined by position measurement that the printed product is pushed back, it is accordingly accelerated and, in the other case, i.e., when it is advanced too far, it is decelerated.

An important advantage of the cutting machine according to the invention is seen in that the mechanical stops, which are used in the prior art, are now replaced by virtual stops. With the aforementioned control, the printed products can move into a corrected and precise position on the way to a virtual stop. The printed products must no longer be released and can be secured by the upper and/or belts even during the cutting process. Since the printed products must no longer be released and can be accelerated for the further transport without having to lower the upper belts, higher production speeds are possible.

With the machine according to the invention the printed products can also be cut at the front side while running through the machine, i.e., without being stopped, as, for example, in the case of a HT 18 Trimmer by AM Graphics or a device according to European patent application 0 698 451.

The cutting machine according to the invention thus makes possible smaller cutting tolerances and, at the same time, a higher production speed.

A further advantage resides in that the rotational speed fluctuations resulting from the forces of gravity of the cutting apparatus can be smoothed by control of the transport device which results in a more quiet and exact advancing action of the transport device.

According to a further embodiment of the invention, the measuring means have at least one laser photocell. Such a laser photocell makes possible a very precise measurement of the position of the printed products in the first cutting station.

According to a further embodiment of the invention, the transport device is driven by an electronically controlled single drive. The play and wear of conventional mechanical step-by-step gear mechanisms is thus avoided. The movement curves for the electronic step-by-step gear mechanism can be stored as a coordinate table. By doing so, for different production conditions such as, for example, product thickness, paper quality, format, and production speed, special optimized movement profiles can be programmed. For an extreme product change, it is possible by simply switching to a different curve table to program an optimal movement course. Such curve tables can be calculated in a simple way according to known movement laws for cam gears. It is particularly advantageous that in the case of an extreme product change a simple switching to another curve table enables programming of a more optimal movement course.

DESCRIPTION OF THE PREFERRED EMBODIMENTS

Figure 1:
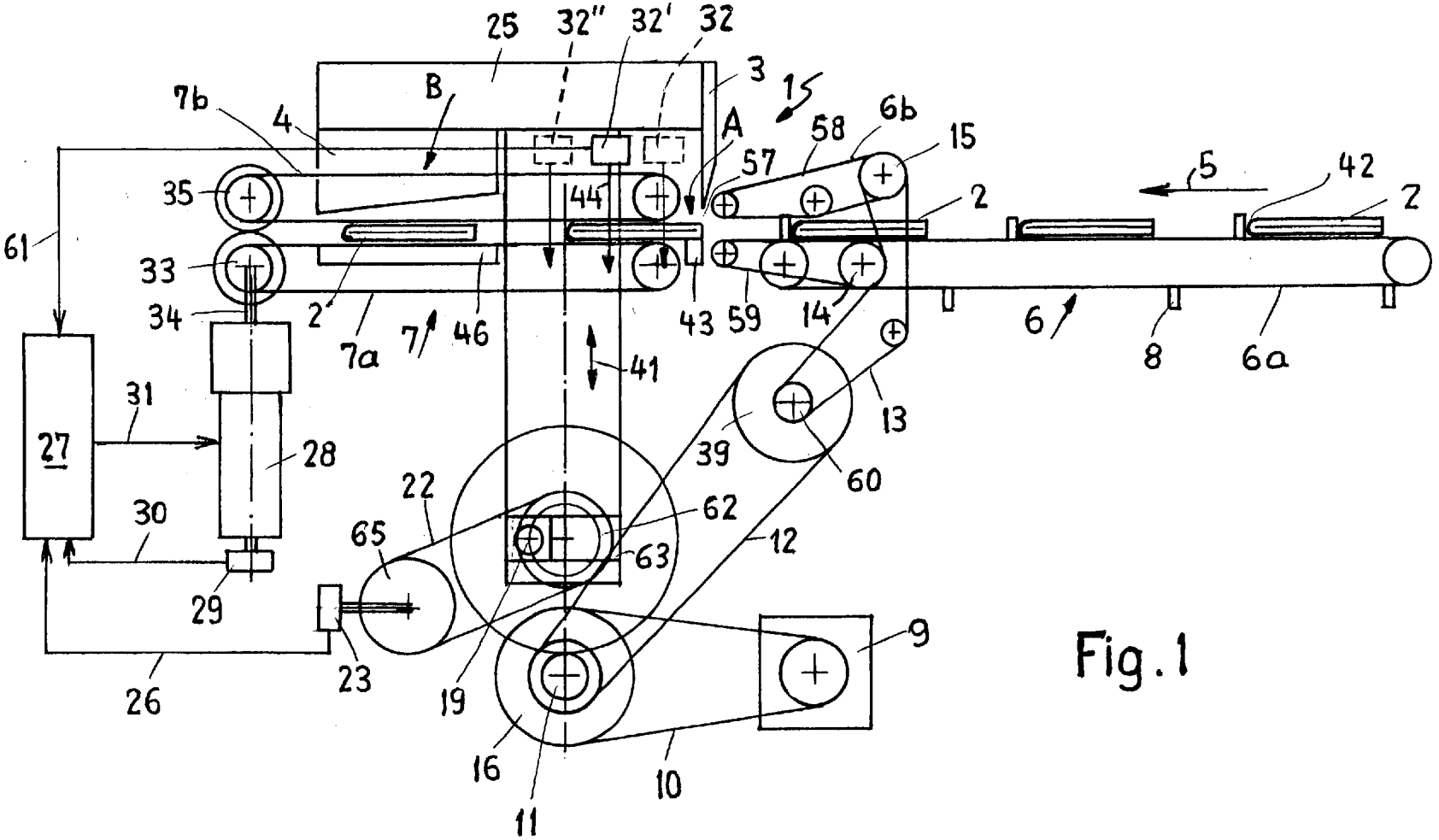
FIG. 1 is a schematic view of the cutting machine according to the invention.
Figure 2:
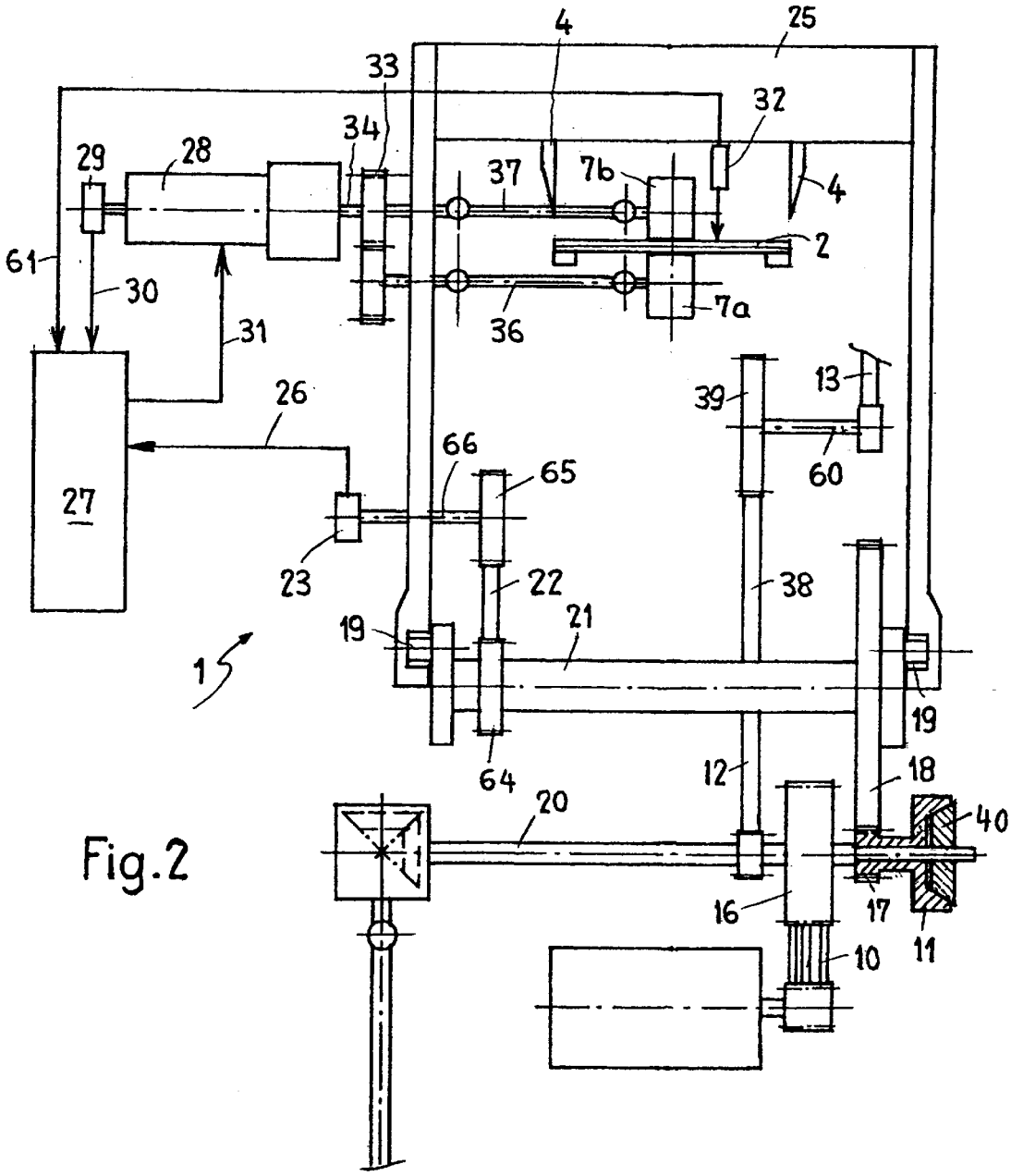
FIG. 2 is a schematic side view of the cutting machine illustrated in FIG. 1.

The cutting machine illustrated in FIGS. 1 and 2 has a feeding device 6 with which the printed products 2 are fed to a first cutting station A. The printed products 2 are received by a transport device 7 and positioned for a front cut at the front cut location 57. After completion of the front cut at the front cut location 57, the printed products 2 are transported by the transport device 6 to a second cutting station B where simultaneously a head cut and a foot cut are performed. The printed products 2 are transported in the transport direction of arrow 5 at a spacing to one another and with a fold or folded area 42 leading in the transport direction. In the area of the feeding device 6, the printed products 2 are positioned at a driver 8. The printed products 2 are brochures, magazines, books or the like.

The feeding device 6 has an endless transport belt 6*a* on which the drivers 8 are fastened at a uniform spacing to one another. At the forward end of the transport belt 6*a* an upper belt 58 and a lower belt 59 are arranged. The printed products 2 are engaged therebetween and fed to the transport device 7. The drive of the feeding belt 6*a* and of the two belts 58 and 59 is realized by means of a drive belt 13 which interacts with the drive wheels 14 and 15. The feeding belt 6*a*, the upper belt 58, and the lower belt 59 transport at the same speed, respectively. The drive belt 13 is connected by means of a shaft 60 and a wheel 39 with a further drive belt 12 that, according to FIG. 2, is connected by means of a shaft 20, drive wheel 16, and drive belt 10 with a main drive 9. The transport direction of the feeding device 6 is illustrated in FIG. 1 by arrow 5.

The transport device 7 has lower belts 7*a* and upper belts 7*b* between which the printed products 2 are transported from the right to the left in FIG. 1. The drive of the belts 7*a* and 7*b* is realized by means of an electronically controlled single drive 28 which is preferably a synchronous servo-drive. The single drive 28 acts via a shaft 34 on the drive roller 33 which meshes with the drive roller 35 of the upper belts 7*b*. The belts 7*a* and 7*b* are driven at the same speed. The individual drive 28 has a sensor or shaft encoder 29 and a signal line 30 is guided from the encoder 29 to the servo converter 27. From this converter 27 a signal line 31 is guided to the single drive 28. The servo converter 27 is connected via a further signal line 61 with a measuring element in the form of laser photocell 32.

The laser photocell 32 provides a measuring device with which the position of the printed products 2 in the first cutting station A is measured. The laser photocell 32 is fastened in a certain position within the first cutting station A above the upper belts 7*b* and emits a laser beam 44 vertically in the downward direction into the transport path of the printed products 2. When a printed product 2 reaches with its folded area 42 the laser beam 44, a corresponding signal generated in the laser photocell 32 is transmitted via the line 61 to the servo converter 27. The laser photocell 32 can be mounted stationarily or slidably. It is also conceivable to provide a configuration with more than one photocell 32, 32', 32". Instead of the photocell 32 any other suitable measuring means can be used. It is however important that with this measuring means the position of the printed products 2 can be determined very precisely and quickly.

The three cuts are carried out by cutting elements in the form of a knife 3 extending transversely to the transport direction 5 and two knives 4 extending parallel to the transport direction 5. These knives 3 and 4 are fastened on a support 25 which forms a yoke with the vertical stays 24. According to FIG. 1, the yoke is moved in two directions as illustrated by the double arrow 41. The drive for performing the cutting stroke is realized by a shaft 21 which has a circular curve 62 arranged at its ends, respectively. Each curve 62 is engaged by a pin 19. The pins 19 are supported in a groove 63 of the stay 24 so as to be horizontally movable. Upon rotation of the shaft 21 the pins 19 are simultaneously horizontally and vertically moved. The vertical movement is transmitted onto the stays 24 and via the support 25 onto the knives 3 and 4. The shaft 21 is driven by means of a gear wheel 18 which meshes with a gear wheel 17 that is coupled by a cone clutch 11 with the shaft 20. By horizontal movement of the cone 40 the clutch can be released and the stroke can thus be adjusted. The clutch 11 can be formed by any suitable superimposed gear mechanism. On the shaft 21 a wheel 64 is seated that drives via a drive belt 22 and a drive wheel 65 a shaft 66 of the shaft encoder 23. This shaft encoder 23 is connected by means of a signal line 26 with the servo converter 27. The encoder 23 measures the angle of the transport device and the measured value is compared in real time with the nominal position value of a corresponding curve table and the angle of the cutting system. The encoder 23 is preferably a high-resolution absolute value encoder.

Figure 3:
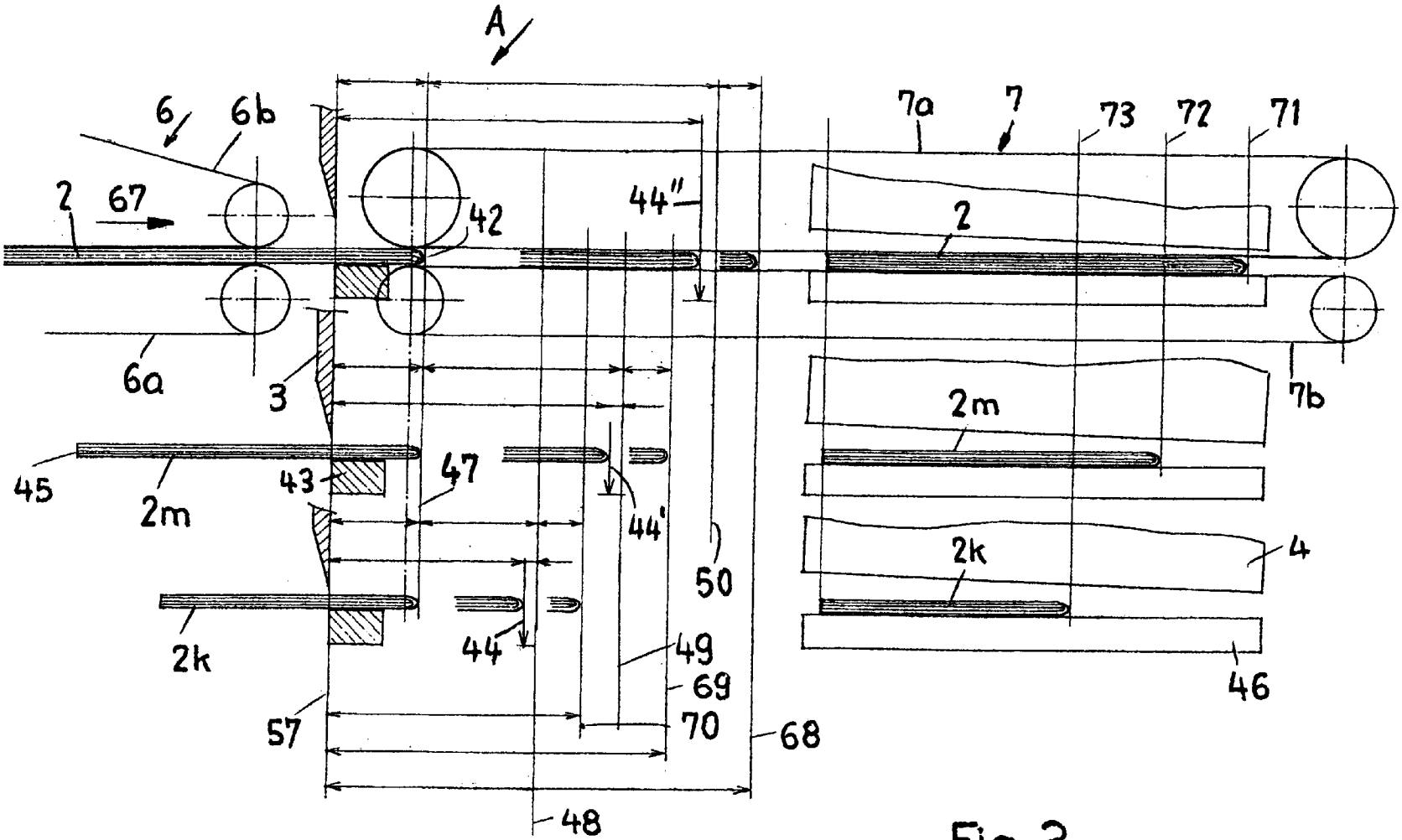
FIG. 3 show schematically the transport of the printed products for the front cut.

In the following, the operation of the cutting machine 1, in particular, with the aid of FIGS. 3 and 4, will be explained in more detail. FIG. 3 shows the front cut performed with the knife 3 and the head cut and foot cut performed with the knives 4 for a long printed product 21, a medium printed product 2*m*, and a short printed product 2*k*. The front cut is carried out, as mentioned above, in a first cutting station A and the head and foot cuts in a second cutting station B.

The feeding into the first cutting station A is realized by means of the feeding device 6 which in FIG. 3 transports the printed products 2*l*, 2*m* or 2*k* in the direction of arrow 67 from the left to the right. FIG. 3 shows the printed products entering into the first cutting station A, respectively, their further transport to the virtual stops 68, 69 or 70, and the subsequent transport to the second cutting station B. FIG. 4 shows the corresponding movement curves 53, 54 and 55. The movement curve 53 corresponds to the short printed product 2*k*, the movement curve 54 to the medium printed product 2*m*, and the movement curve 55 to the long printed product 2*l*. In FIG. 4, the horizontal ordinate 51 shows the transport path of the printed products 2*k*, 2*m*, and 2*l* in mm. The vertical ordinate 52 shows the rotational angle. The zero point 70 is the transfer point at which the folded area 42 of the printed products 2 is engaged by the transport device 7. FIG. 3 shows to the left that position of engagement of the folded area for the printed products 2*l*, 2*m* and 2*k*, respectively.

Figure 4:
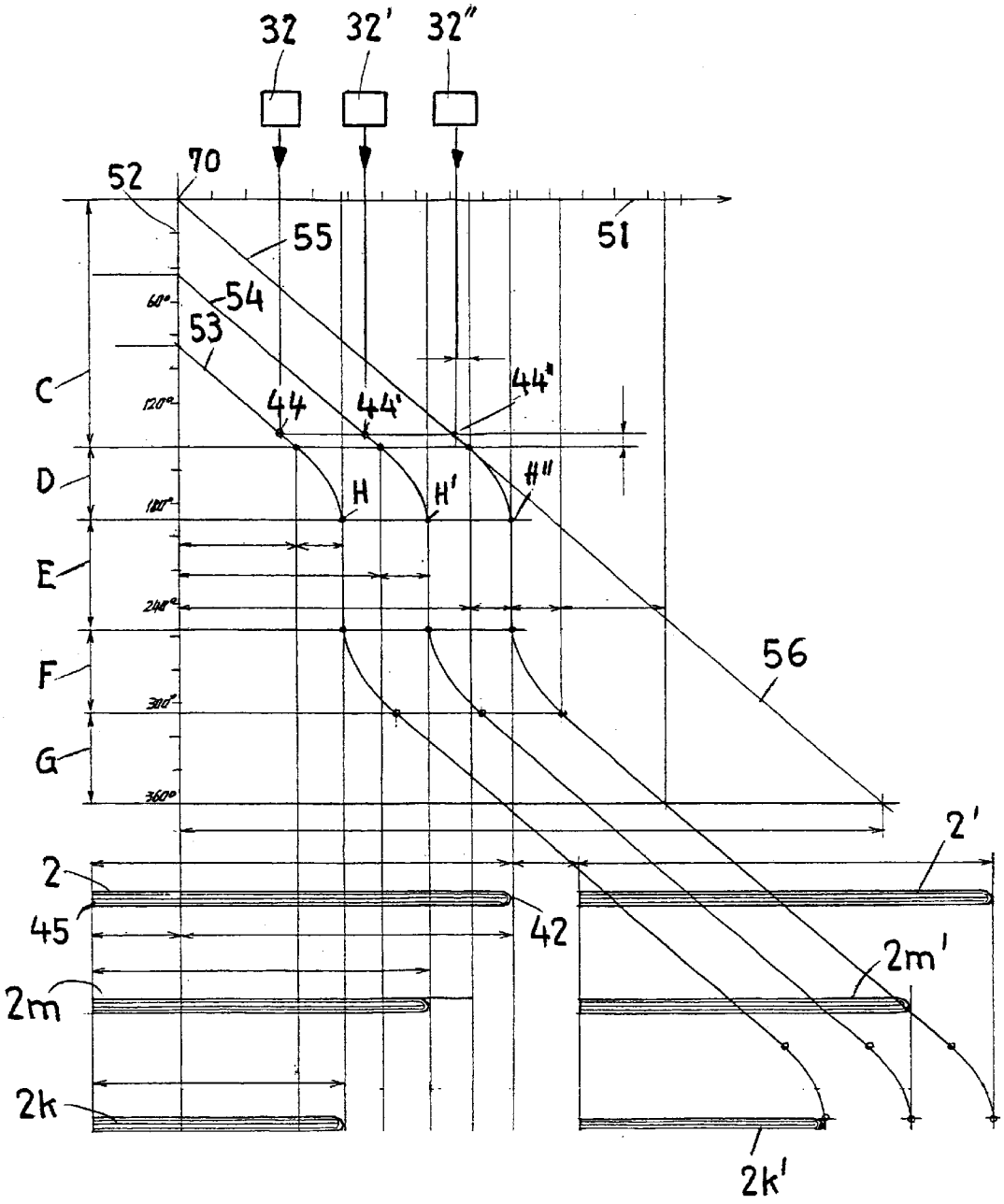
FIG. 4 shows movement curves for three different formats of the printed products.

As illustrated in FIG. 4, between the feeding device 6 and the transport device 7 synchronous movement is provided at least as long as the printed products 2 are transported by both devices 6 and 7. During this synchronous running, the printed products 2*l*, 2*m*, and 2*k* reach with their folded area 42 the laser beam 44, 44', or 44". The position of each laser photocell 32, 32', 32" is matched to the length or width of the printed products 2. For the short printed product 2*k*, the corresponding laser beam 44 is closer to the front cut location 57, which is illustrated in FIG. 3 by the line 47. The spacing of the laser beam 44 to the line 57 is determined and is shorter than the width of the printed product 2*k*. The laser beams 44' and 44" have a correspondingly larger spacing to the line 57. When the printed products 2*l*, 2*m*, 2*k* reach with their folded area 42 the corresponding laser beam 44, 44', 44", the photocell 32 sends via the line 61 a corresponding signal to the servo converter 27. The latter now determines the position of the printed products 2*l*, 2*m*, 2*k* with respect to the rotational angle. Upon further transport, the printed products 2*l*, 2*m*, 2*k* leave the feeding device 6 and are now engaged solely by the transport device 7. Teh printed products 2 thus leave the synchronous movement area identified in FIG. 4 by the letter C.

The further transport of the printed products 2 to the virtual stop 68, 69, 70 is now controlled as a result of the position measurement by means of the photocell 32 and, if needed, corrected. When the position measurement has shown that the printed product 2*l*, 2*m*, 2*k* lags behind relative to the nominal position, the transport speed of the transport device 7 is increased such that the printed product 2*l*, 2*m*, 2*k* has reached the exact position when arriving at the virtual stop 68, 69, or 70 and that, moreover, the speed is zero. The control is realized by means of curve tables which can be calculated based on known movement laws for cam gears or cam drives. The corresponding programs are stored in the servo converter 27.

When the printed products 2*l*, 2*m*, 2*k* are positioned with their folded area 42 at the virtual stop 68, 69, 70, respectively, they are stopped (stand still) and are held by the two belts 7*a* and 7*b*. The control area D illustrated in FIG. 4 now shows a transition into the stop area E. In this area E, the printed products 2*l*, 2*m*, 2*k* are cut by the knife 3 and thus the front cut is carried out. Once this front cut is performed, the printed products 2*l*, 2*m*, 2*k* are further transported by the transport device 7. It is important in this connection that the printed products during the front cut must not be released as has been required in the case of mechanical stops of the prior art. In the acceleration area F shown in FIG. 4, the printed products 2*l*, 2*m*, 2*k* are accelerated again until they reach area B where synchronous movement with the feeding device 6 is again provided. At this point in time, the transport device 7 engages the following printed product. This printed product is then moved, as explained above, again into the cutting position for the front cut. The previously cut printed product is moved to the second cutting station B. The knives 4 and the counter knives 46 perform now the head cut and the foot cut. These cuts are carried out simultaneously with the front cut because the knives 3 and 4 are fixedly connected to one another by the support 25 and therefore move simultaneously. The knife 3 cooperates with the counter knife 43.

The positioning of the printed products 2*l*, 2*m*, 2*k* relative to the transport direction is substantially less critical than for the front cut because it is parallel to the transport direction 67. It is important in this connection that also for the head and food cuts the printed products are engaged by the two belts 7*a* and 7*b* and secured thereby. The printed products 2*l*, 2*m*, 2*k* are thus never released during the entire transport within the cutting stations A and B and can thus also not slide or slip in an uncontrolled way. After performing the head and the foot cuts, the printed products 2*l*, 2*m*, 2*k* are transported further and can then be transferred to devices, not illustrated in the drawing, further processing.

It is also possible to eliminate mechanical stops in the second cutting station B. In FIG. 3 the virtual stops 71, 72, and 73 are adjusted so as to match the width of the printed products 2*l*, 2*m*, 2*k*. However, in principle, mechanical stops can be provided in the first cutting station A as well as in the second cutting station B. It is however also important in this connection that the printed products 2*l*, 2*m*, 2*k* are measured by means of a photocell 32 or a different measuring device with respect to their position and that their position is correspondingly corrected based on this measurement with respect to positional deviations. This is also advantageous in connection with mechanical stops because the printed products 2*l*, 2*m* and 2*k* can then be positioned more gently and more precisely at the mechanical stops. In the preferred embodiment, preferably only virtual stops 68 through 73 are provided. In the above described cutting machine 1 two cutting stations A and B are provided. However, conceivable is also an embodiment in which only one cutting station A for the front cut is provided. In principle, the head and the foot cuts can also be performed before the front cut is carried out and in a different cutting machine. Accordingly, the simultaneous performance of the three cuts is not mandatory.

While specific embodiments of the invention have been shown and described in detail to illustrate the inventive principles, it will be understood that the invention may be embodied otherwise without departing from such principles.

What is claimed is:

1. A cutting machine for automatically trimming edges of folded printed products, the cutting machine comprising:

a first cutting station comprising a cutting element configured to perform a front cut at a front cut location on an open side of the printed products;

a feeding device configured to transport the printed products to the first cutting station;

a transport device configured to transport the printed products received from the feeding device in a transport direction through the first cutting station;

a measuring device configured to measure a position of each of the printed products in the first cutting station before reaching a cutting position;

a control device configured to control the transport device based on the position measured by the measuring device such that a deviation of the position measured by the measuring device from a nominal position is corrected during further transport of the printed products, further comprising a sensor measuring an angle of the transport device, wherein the angle of the transport device measured by the sensor is compared in real time with a nominal position value of a curve table and an angle of the cutting element.

2. The cutting machine according to claim 1, wherein the printed products have a fold and wherein the measuring device is configured to measure a spacing of the fold to the products.

3. The cutting machine according to claim 2, wherein the printed products are transported on the transport device with the fold leading.

4. The cutting machine according to claim 1, further comprising a second cutting station, wherein the transport device transports the printed products from the first cutting station to the second cutting station.

5. The cutting machine according to claim 1, further comprising an electric single drive configured to drive the transport device.

6. The cutting machine according to claim 5, wherein the electric single drive comprises a servodrive.

7. The cutting machine according to claim 6, wherein the servodrive is a synchronous servodrive.

8. The cutting machine according to claim 1, wherein the transport device is controlled such that the printed products are slowed to a standstill for performing the front cut.

9. The cutting machine according to claim 8, wherein the first cutting station comprises a virtual stop and wherein the printed products are stopped at the virtual stop.

10. The cutting machine according to claim 1, wherein the printed products are cut without being stopped.

11. The cutting machine according to claim 1, wherein the measuring device is adjustable in the transport direction for adaptation to different formats of the printed products.

12. The cutting machine according to claim 1, wherein the measuring device comprises several measuring elements arranged in different positions and wherein each one of the measuring elements interacts with a different format of the printed products.

13. The cutting machine according to claim 1, wherein the measuring device comprises at least one laser photocell arranged in the transport direction behind the front cut location.

14. The cutting machine according to claim 13, wherein the laser photocell emits a laser beam that is directed downwardly into a transport path on the transport device.

* * * * *